US005193612A

United States Patent [19]

Stirnkorb

[11] Patent Number: 5,193,612

[45] Date of Patent: Mar. 16, 1993

[54] MULTIPLE-PLATE HEAT EXCHANGER FOR PRESSURIZED FLUIDS

[75] Inventor: Ulrich Stirnkorb, Bretten, Fed. Rep. of Germany

[73] Assignee: W. Schmidt-Bretten GmbH, Bretten, Fed. Rep. of Germany

[21] Appl. No.: 800,486

[22] Filed: Nov. 29, 1991

[30] Foreign Application Priority Data

Nov. 29, 1990 [DE] Fed. Rep. of Germany ..... 4037969

[51] Int. Cl.[5] ..... F28F 3/10

[52] U.S. Cl. ..... 165/167; 165/70

[58] Field of Search ..... 165/11.2, 70, 166, 167

[56] References Cited

U.S. PATENT DOCUMENTS

| | | | |
|---|---|---|---|
| 2,777,674 | 1/1957 | Wakeman | 165/166 |
| 3,438,435 | 4/1969 | Wennerberg | 165/167 |

FOREIGN PATENT DOCUMENTS

| | | | |
|---|---|---|---|
| 1451193 | 9/1969 | Fed. Rep. of Germany . | |
| 86728 | 12/1971 | Fed. Rep. of Germany . | |
| 2629157 | 2/1977 | Fed. Rep. of Germany . | |
| 2741712 | 3/1978 | Fed. Rep. of Germany . | |
| 3300523A1 | 7/1984 | Fed. Rep. of Germany . | |
| 3544588A1 | 6/1987 | Fed. Rep. of Germany . | |
| 3903084A1 | 8/1990 | Fed. Rep. of Germany . | |
| 905982 | 6/1991 | Fed. Rep. of Germany . | |
| 9101880.3 | 6/1991 | Fed. Rep. of Germany . | |
| 2355265 | 1/1978 | France . | |
| 587784 | 6/1959 | Italy | 165/166 |
| 842962 | 8/1960 | United Kingdom | 165/166 |
| 894462 | 4/1962 | United Kingdom | 165/166 |
| 1562335 | 3/1980 | United Kingdom . | |
| 2057668A | 4/1981 | United Kingdom | 165/166 |
| 2114248A | 8/1983 | United Kingdom . | |
| 2117890A | 10/1983 | United Kingdom | 165/166 |
| 2141814A | 1/1985 | United Kingdom . | |

*Primary Examiner*—Allen J. Flanigan

*Attorney, Agent, or Firm*—Frishauf, Holtz, Goodman & Woodward

[57] ABSTRACT

A heat exchanger using a stack of plates with sealed flow spaces between them utilizes a multiplicity of plates that fit flush together at their perimeters and are provided with profiling by stamping. They are essentially the same in shape and are alternately rotated, in the planes of the respective plates, by 180° with respect to each other for stacking. Before they are compressed into a stack, sealing profile members are inserted which fit into grooves for providing a perimeter seal. The flow spaces between the plates serve alternately for a first and a second fluid medium, which are guided in parallel counter-current through the stack, passing through perforations in the corners of the plates. At least part of the plates are thus releasably stacked with removable sealing profile members. The removable perimeter seals between plates are constituted as multiple seals having at least two profile members at a substantially constant distance from each other. The profile members may be joined by bridges to another profile member for facilitating assembly and disassembly, but the bridges are dimensioned so as to allow the channels between the two profile members connected by the bridges to be continuous around the perimeter. The channels may be used for circulation of a third medium for improving the sealing function.

28 Claims, 4 Drawing Sheets

MULTIPLE-PLATE HEAT EXCHANGER FOR PRESSURIZED FLUIDS

This invention concerns a heat exchanger utilizing metal plate elements which are substantially rectangular plates that fit flush against each other and are provided with stamped or pressed profiling on their surfaces, these plates being alternately rotated by 180° with respect to neighboring plates, the plates being compressed, at least partly releasably, into a stack with the profile surfaces of successive plates adjacent to each other. In this arrangement the plates provide inter-plate channels alternately for a first and second fluid medium which can progressively flow substantially parallel to each other, sealing members being provided around the perimeter of the flow spaces between the plates, the sealing inserts fitting into grooves in the plates. The plates are sealed flush together and thereby form the flow spaces between adjacent plates to and from which a fluid medium can be supplied and removed by perforations in the corner regions of the plates. The sealing members between the plates are releasable from the plates and are constituted as releasable perimeter sealing members.

In heat exchangers of the above described kind the relatively thin-walled plates which are in many ways also similar to each other in shape are held together in a frame and compressed into a stack between thicker end plates which consist of a so called base or mounting plate and a so called cover plate, with the base plate and/or the cover plate providing the connections for the media which are guided through channels transversing the plate stack, with the above mentioned perforations of the plates being provided with suitable configuration details of the sealing members. In such equipment the sealing of the plates to each other can consist, at least in part, of welded, soldered or adhesive joints, or the like, with suitable profiles for such sealing, while the plates which are releasable from each other utilize a perimeter sealing member which is at least in part of elastic material.

The flow spaces that are formed between the plates when they are pressed together exert pressure against the plate as a result of the presence of the first and second flow media. This however results in setting a possible limit on the applied fluid pressure determined by the load which can be opposed by the perimeter sealing members that are at least in part made of elastic material. Of course, the plate stack can be pressed strongly together to provide a high compression between base and cover plates. Here again a limit is found when the material of the perimeter seals is crushed.

If it is desired to carry out heat exchange between fluid media that are under high pressure, it has been necessary to go over to other types of heat exchangers, for example, heat exchangers utilizing pipes. Such pipe heat exchangers are substantially higher in cost for comparable heat exchange capacity and much more difficult to install, rearrange or repair than plate heat exchangers.

SUMMARY OF THE INVENTION

It is an object of the present invention to provide a plate heat exchanger of the above mentioned kind, by modification or complementation, that is basically simple and yet permits going beyond the pressure load limits heretofore observed with comparatively moderate increase of the cost of manufacture.

Briefly, at least over a major portion of their length the perimeter sealing members are provided by plural (at least two) seals with suitable seal profile members spaced from each other.

This feature of the invention has the effect that between neighboring profiles of the multiple seal a narrow channel is formed which is sealed on both sides. Hence, for example, in the case of a double seal, when there is leakage from a seal facing a pressurized medium, an intermediate pressure is built up in the channel that, on the one hand, can be withstood safely without leakage from the seal more remote from that medium, while the intermediate pressure provides support and a counterpressure effect for the seal which is closer to that medium. Overall, therefore, the fluid medium pressure is reduced by steps towards the environmental pressure which is normally at the atmospheric pressure, so that each of the parallel seal profiles has to bear only a part of the difference between fluid medium pressure and environmental pressure.

These relations apply correspondingly for multiple seals with three or more parallel seal profile members.

In accordance with a particular embodiment or a particular application of the invention, the multiple sealing can be arranged to include a seal, in each case, between a flow space or chamber and those perforations of the plates in question which must have no connection with that space or chamber and serve merely for passage of a fluid medium to the space or chamber which is next in the stack. This usually present sealing zone is one of the critical, if not actually the most critical, sealing zone between two neighboring plates, since the plate usually has no support of the sealing zone facing the neighboring plate on the side facing away from the seal in question, because the appropriate fluid medium must be supplied or removed to or from the neighboring flow space through the perforation above mentioned. As a result of that absence of a support the seal cannot be prestressed as strongly at this place as in the remaining parts of the perimeter seal, so that under fluid medium pressures any leakage will first occur at this location.

According to another embodiment of the invention the entire seal around the perimeter consists of at least two seal profile members spaced from each other. This permits a substantial increase of the pressure applied to the fluid media used for heat exchange for which a plate-type heat exchanger can be used.

On the basis of comparing heat exchangers with the same heat exchange surface of the plates, the doubling, tripling, quadrupling, etc. of the perimeter seal between adjacent plates corresponds in effect to an enlargement of the plates. The base and cover plates must be correspondingly enlarged and dimentioned for greater strength and stronger or more numerous compression means must be provided for the plate stack. These complications and related expenses are nevertheless held within overall and economically tolerable limits, compared for example with the alternative mentioned above of going to another kind of heat exchanger having the construction of a pipe heat exchanger.

It is also useful within the scope of the invention to hold the profiles of the perimeter seal member in a known way by setting them in seal grooves stamped or otherwise provided in the plates. The depth of these grooves corresponds to a portion of the height of the particular seal member profile. In this case the profile of the plate is given a corresponding rise in the channel formed between neighboring sealing profiles, in order to support the sealing profiles with respect to the channels. That rise must of course not go all the way across the perimeter region gap between adjacent plates.

It is further advantageous for neighboring profiles of the plural seal arrangement to be connected at individual locations for spacing from each other by bridges running transversely to the lengthwise disposition of the sealing members. These bridges are made of the material of the perimeter sealing and integrally connected thereto. In this way a substantially easier installation and easier handling are made possible.

In the embodiment just described, it is useful for the height of the bridges to be reduced in comparison with the seal member profiles to such an extent that between the sealing profiles of the multiple seal arrangement a channel is formed that is continuous in the longitudinal direction defined by the sealing members (i.e. in the region around the perimeter of the plate). In this way pressure equalization is made possible over the entire length of the channel, so that different pressures cannot build up on opposite sides of one of these bridges.

In this connection it is also useful that the plate profiling existing between neighboring seal grooves should be reduced in its height at the places where the bridges are located. In that way an excessively thin shape of the bridges is prevented.

In a further development of the invention, it is expected that the plates should have holes in regions between neighboring profiles of the channels formed by the perimeter seals. Through these holes the inter-seal channels can be filled with a third fluid medium which is under pressure higher than atmospheric pressure, with the magnitude of this overpressure supplied between, on the one hand, the pressures of the first and second fluid media and, on the other hand, the environmental pressure in the neighborhood of the plate heat exchangers.

This design provides the possibility of filling the channels formed between the perimeter seals with a blocking fluid medium, for example, a liquid or a gas, by which any accumulation of quantities of the first or second fluid medium in the channels is prevented. In this manner it is also possible to produce an aseptic plate heat exchanger. If in spite of this precaution some of the first or second fluid medium should occasionally penetrate into one of the channels, this leakage material can be immediately flushed out with ease by means of the third fluid medium.

In development of the above mentioned possibility it is desirable for the multiple seal to be in the form of a double seal and for the magnitude of the overpressure of the third medium to be somewhere in the middle between, on the one hand, the pressures of the first and second fluid media and, on the other hand, the pressure of the environment of the plate heat exchanger.

In this connection, starting from a plate heat exchanger in which the plates are compressed in a frame situated between a support or backing plate and a cover plate of the frame, with the plates of the stack held flush to each other (but releasable) in a stack, the backing or support plate and/or the cover plate would have connection couplings corresponding to the channels for supplying and, if also desired, removal of the third fluid medium.

DRAWINGS

The invention is further described by way of illustrative example with reference to the annexed drawings, in which.

DESCRIPTION OF THE ILLUSTRATED EMBODIMENTS

Figure 1:
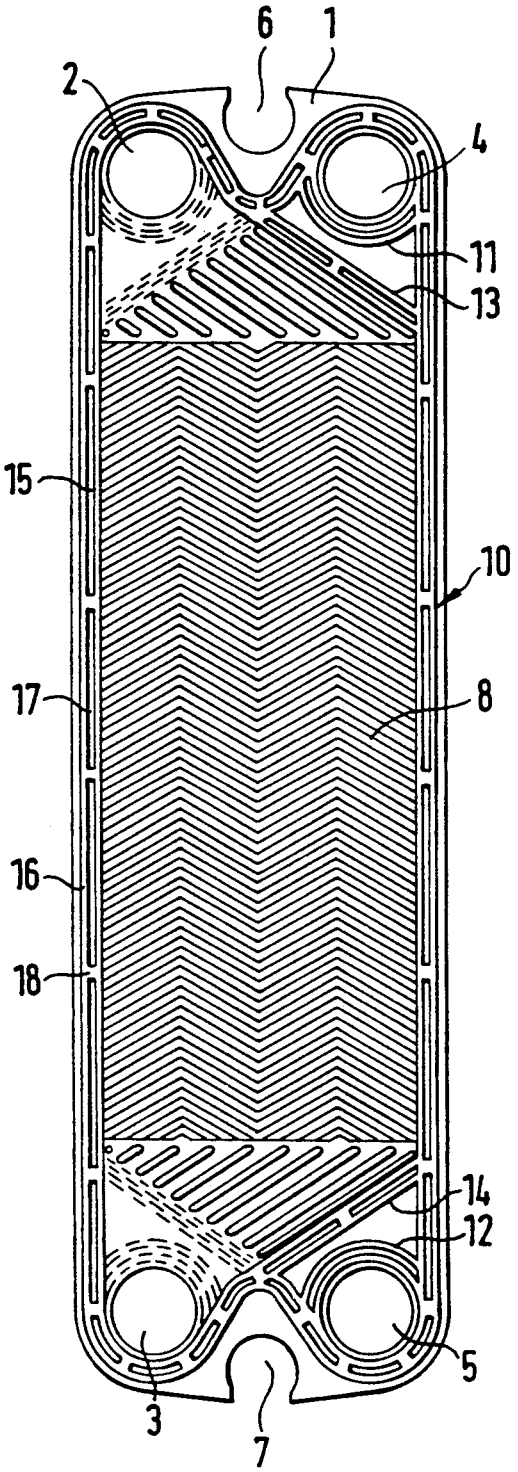
FIG. 1 is a front view of a releasable heat exchanger plate.

The heat exchanger plate 1 shown in FIG. 1 has easily recognizable corner perforations 2, 3, 4 and 5 through which, in a known way, in the case of a plate stack of a plate heat exchanger, the two fluid media taking part in heat exchange are guided along the stack. Between the perforations 2 and 4 at one end (at the top in FIG. 1) and the perforations 3 and 5 on the other end (at the bottom in FIG. 1) the plate 1 has cut-outs 6 and 7 which are open outwards. The rods of a framework can be put in place through these cut-outs, the framework having in the usual way a support plate and a cover plate, between which the stack of plates 1 can be compressed together.

In its mid-region the plate 1 has profiling 8 of zigzag appearance in front view. Such profiling extends over the surfaces neighboring plates set to face each other in such a way that flow spaces are formed between neighboring plates through which the first fluid medium or the second fluid medium, as the case may be, can advance through the flow space.

The flow spaces are outwardly bounded by a perimeter seal 10, which, in the case of FIG. 1, permits the medium flowing over the visible side of the plate 1 to move between the perforations 2 and 3. Laterally opposite to the perforations 2 and 3 are the perforations 4 and 5 which are partitioned from the flow space above described, first by a surrounding seal 11, 12 and additionally by a preliminary barrier provided by the seal portions 13 and 14 of the perimeter seal 10.

In this illustrated case the perimeter seal is, as is visible in FIG. 1, in the form of a double seal. A seal member profile 15 facing the flow medium and a seal member profile 16 facing away from the flow medium are installed parallel to each other in such a way that between these two sealing profiles a channel 17 is produced. This construction has the effect, as already mentioned, that the pressure in the interior of the flow spaces is reduced stepwise towards the level of the environment surrounding the plate heat exchanger, so that the flow spaces can be put at very high flow medium pressures without allowing the occurrence of leakage as a result.

As is additionally visible in FIG. 1, the inner seal profile member 15 and the outer seal profile member 16 are connected to each other in many places along the course of the perimeter sealing by bridges 18, in order to facilitate this type and manner of assembly of the seal on the plate 1.

The perforations 4 and 5 have seals 11 and 12 that encircle these perforations and these perforations are isolated thereby, as well as by the barrier seals 13 and 14, from the flow chamber on the visible side of FIG. 1. These circular portions of the sealing insert 10 provided between the plates provide for connections of the perforations 4 and 5 to respective perforations, similarly equipped, of another plate that would fit in front of the plate 1 of FIG. 1. Broken-line circular arcs near the perforations 2 and 3 show that on the side of the plate 1 which is not visible in FIG. 1 those perorations are equipped with circular seals similar to those shown at 11 and 12 for making tight junctions with corresponding perforations, similarly equipped for junction, of another plate that would fit in back of the plate 1.

Figure 2:
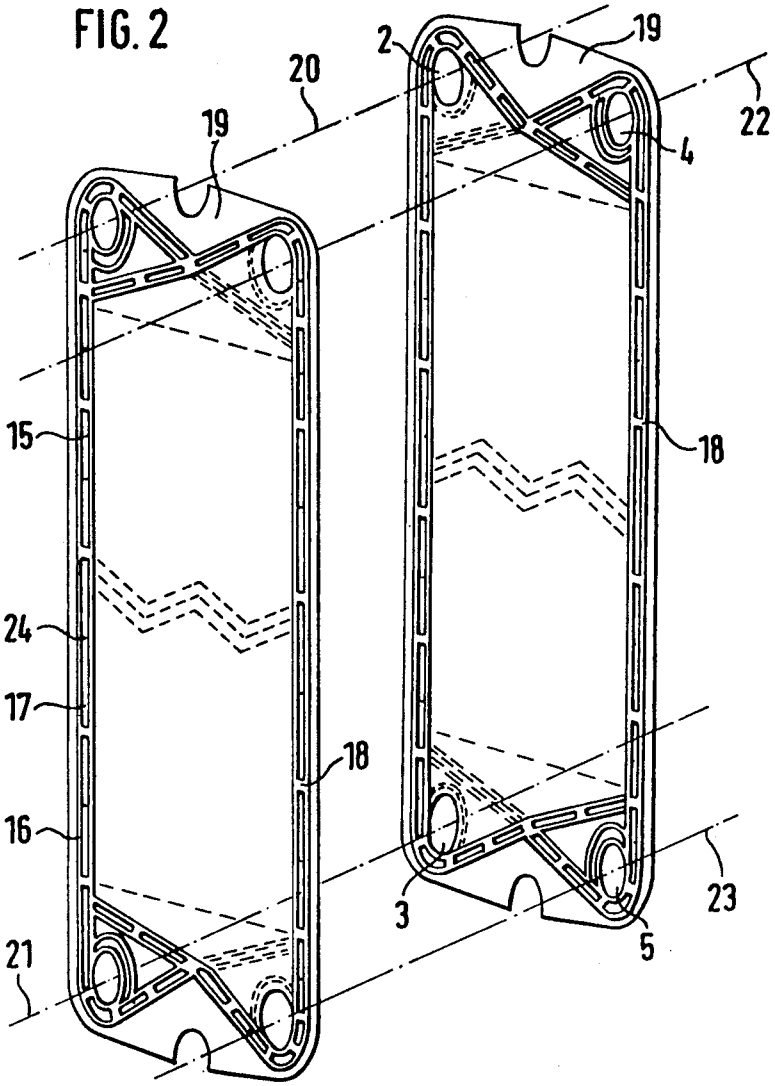
FIG. 2 is a perspective view of two neighboring heat exchanger plates of the kind shown in FIG. 1 in an exploded position.

FIG. 2 shows two plates 19 of the kind described with reference to FIG. 1. They are shown in an exploded position so that it can be seen how they come to lie against each other ultimately in the plate stack. FIG. 2 also shows that the two plates in the illustrated example which are identical with each other in shape, go together with one plate rotated, in the plane of the plate, by 180° against the other. In consequence, starting from the flow channels 20, 21, 22 and 23 formed by the perforations of the plates, on the one hand the flow space formed by the two illustrated plates can be filled and drained through the flow channels 20 and 21, while the flow spaces lying in front of the forward plate 19 and beyond the rear plate 19 can be filled and drained through the flow channels 22 and 23. The plates do not need to be identical in the profiling shown at 8 in FIG. 1, but it is important for them to have the same shape of profiling in the region adjacent to the perimeter of the plates. In other words, they should be of essentially the same configuration.

Unlike the representation of the plate of FIG. 1, the plates 19 shown in FIG. 2 have bores 24 through the plate material located between the inner seal profile member 15 and the outer seal profile member 16, through which the neighboring channels 17 of adjoining plates are connected with each other. This provides, in the manner already described, the possibility that the channels 17 can be filled with a third fluid medium in order to build up in this third medium a differential pressure between the two sealing profile members, so that at the same time it becomes possible to flush out any leakage that may penetrate through the inner seal profile member 15.

Figure 3:
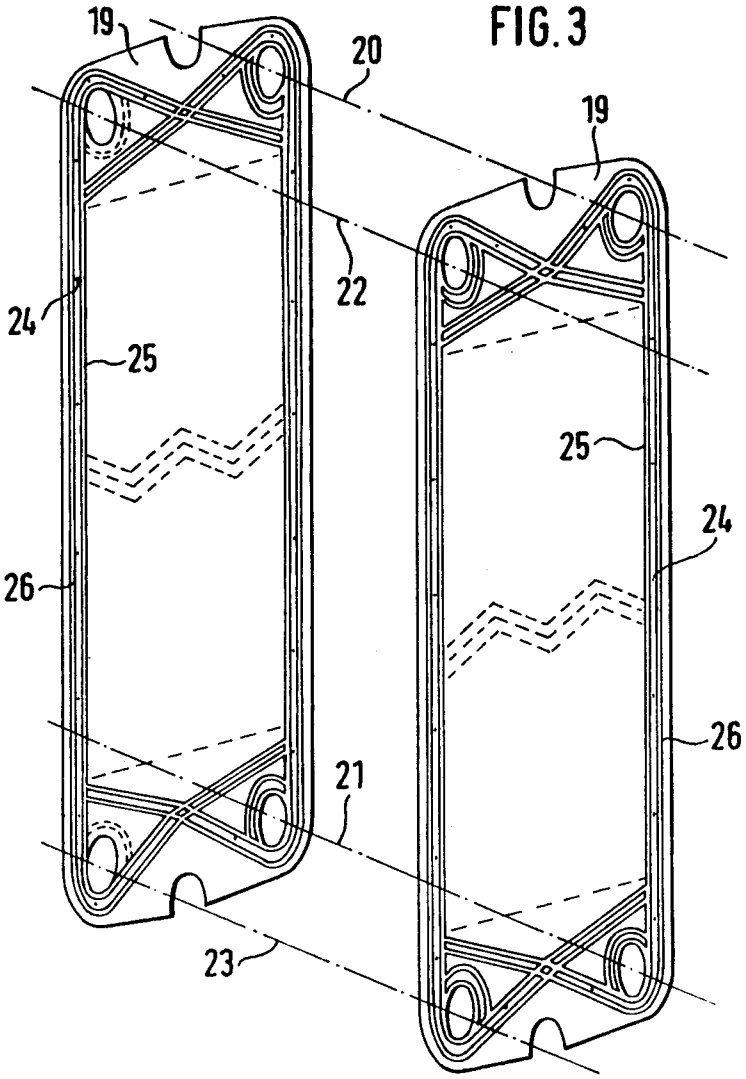
FIG. 3 is a rear perspective view of the heat exchanger plates shown in FIG. 2.

FIG. 3 shows the two plates 19 according to FIG. 2 in a rear view, in which is visible the protrusion of the grooves 25 and 26 into which the seal profile members 15 and 16 are inserted.

Figure 4:
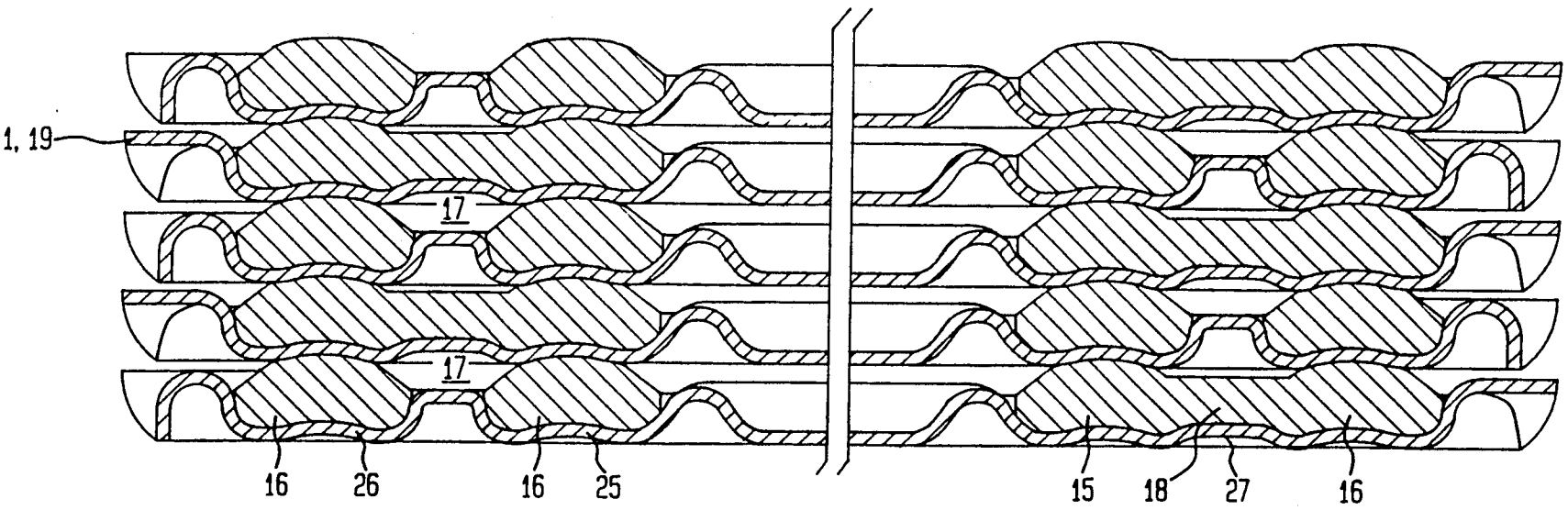
FIG. 4 is a cross section with the central portion of the plates omitted, through the sealing regions near opposite longitudinal edges of several heat exchanger plates stacked one against the other in accordance with FIGS. 2 and 3.

FIG. 4 shows, in magnified representation, a section perpendicular to the plane of the heat exchanger plates 1, 19 in the region of the perimeter seals adjacent to both lateral edges of the plate, with the central portion of the plate cross-sections omitted. Here it is visible how the seal members of different individual locations are connected together by bridges 18. The bridges have a reduced height compared to the seal profile members 15 and 16, in order to make possible the provision of continuous channels 17 extending around the entire seal perimeter. In order that the bridges 18 should not need to be provided with too small a thickness dimension, the plate profiling 27 between the sealing profiles 15 and 16 is likewise reduced in its height in the region of the bridges 18.

FIG. 4 also shows that the plates, when alternate plates are rotated by 180° in the plane of the plate, can hold a sealing insert as above described by means of profiling that is the same in all plates in their outer regions. FIG. 4 is designed to show the effect of the presence of the bridges 18. Of course there will be many possible cross sections showing no bridges. Some of those would be appropriate for the location of bores through the plates for access to the channels 17 as above described in connection with the bores 24 of FIG. 2.

The bores 24 can be all connected together for making possible the supply and removal of the third medium to the channels 17 of the respective plates, either in series or in parallel. This is shown in FIG. 5 where the unit 75 is a pressure regulator for the third fluid showing both the inlet and outlet pressures.

The inlet through the backing plate 30 is shown at 71, connected to a pipe that both to the pressure regulator 75 and to the supply pipe 77. The outlet is shown at 70 which similarly has a pipe 72 connected both to the pressure regulator 75 and to the fluid removal pipe 76.

Figure 5:
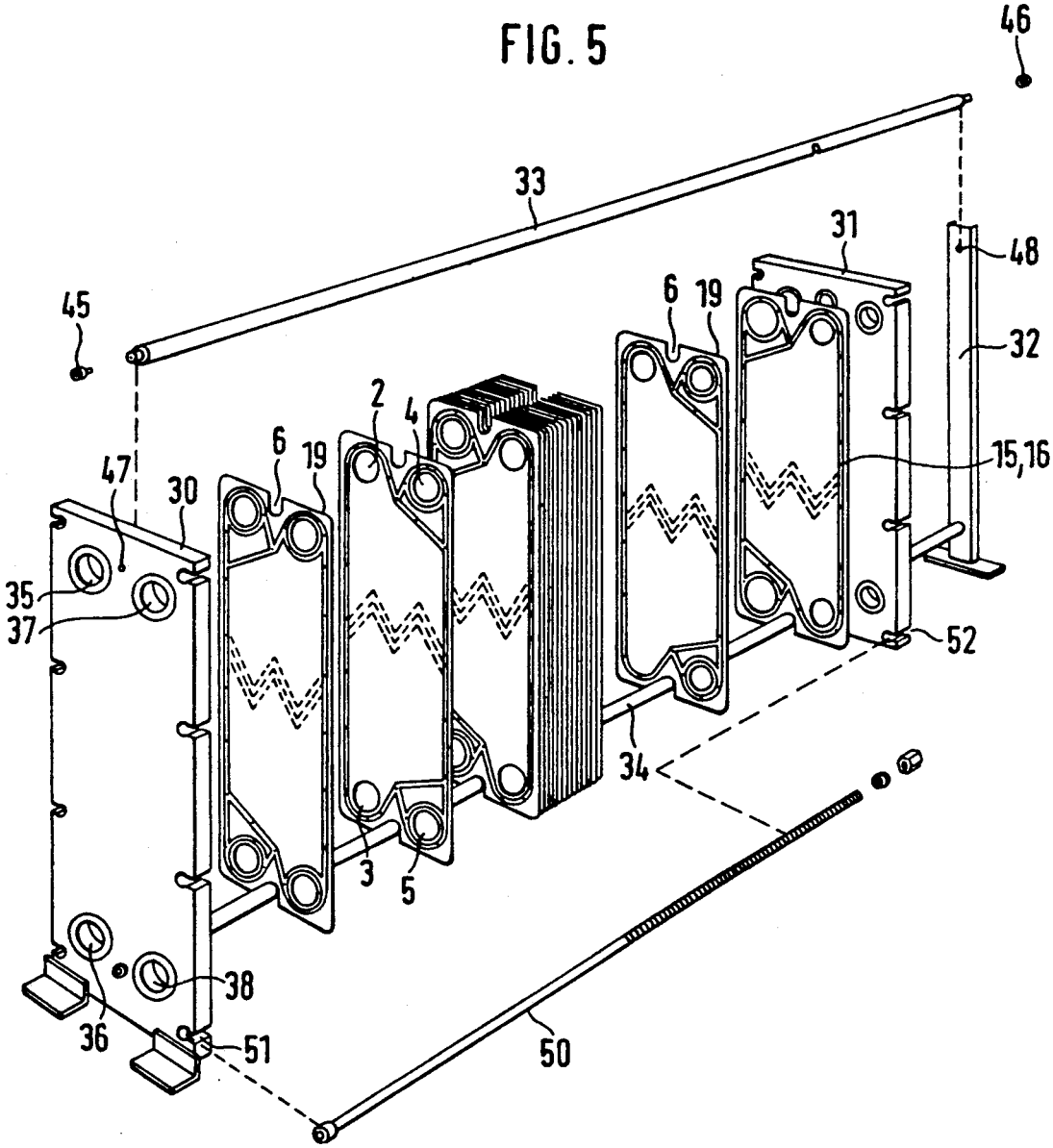
FIG. 5 is a partly exploded perspective view of a heat exchanger having plates in accordance with FIGS. 1–4.

FIG. 5 shows, finally, a perspective overall view of a plate heat exchanger, mostly in an exploded representation, having the features shown in FIGS. 2 and 3. In FIG. 5 it can be seen how the plates 19 are stacked with alternate plates rotated by 180° with respect to their neighboring plates and also the presence of a base plate 30 and a cover plate 31, as well as a vertical post 32 from which rods 33 and 34 extend to the base plate 30. These rods guide the plates 19 by means of their cut-out 6 and adjust the positions of the plates with respect to each other. The rods 33 and 34 are fixed in position by screws 45 and 46 in bores 47 and 48 respectively of the base and cover plates.

The support and cover plates form connection openings 35 to 38 which corresponds to the perforations 2 to 5 of the plates and therefore connect the channels 20 to 23 of FIGS. 2 and 3 to the exterior.

One of many clamping rods is shown at 50. They are set in slots 51 and 52 of the support and cover plates where they serve for compressing these plates together and thereby provide between the support and cover plates, an aligned compressed stack or pack of heat exchanger plates.

Although the invention has been described with reference to a particular illustrative example, it will be recognized that modifications are possible within the inventive concept. For example, instead of the perforations 2 and 3 shown in FIG. 1 as serving as inlet and outlet for the flow chamber on the visible side of the plate 1, the perforations 2 and 5 might be so used (diagonal flow) while the perforations 3 and 4 are isolated from that flow chamber and serve for passing the other fluid medium. Also it should be mentioned that the plate heat exchangers of the invention can be operated with each medium passing through its flow chambers in parallel or in series (in the latter case each by a meandering flow path through the stack).

I claim:

1. A multiple-plate heat capable of use for heat exchange between fluids that are under pressure, comprising:

substantially rectangular plates fitting closely to each other, each having stamped profiling of their surfaces, said plates being of the same material and of essentially the same configuration, stacked with said plates alternately rotated 180° with respect to each other, at least a part of the total number of said plates being compressed together into stack by means for compressibly but releasably stacking said plates together, respective profiled surfaces of successive plates facing each other, whereby flow spaces are formed between the plates;

sealing means respectively surrounding said flow spaces in respective regions of said plates adjacent to their perimeters, which are removable from those of said plates which are releasably stacked together and released;

positioning means, provided on at least half of said plates which are releasably stacked together, for assuring location of said sealing means in said region of said plates when said plates are stacked together;

each of said plates having perforations in their respective corner regions for serving as inlets and outlets for first and second fluids, a first pair of said perforations in corner regions separated from each other at least in the direction of a major dimension of the substantially rectangular plates serving respectively as inlet and outlet for leading a first fluid into and out of a said flow chamber on a first side of a said plate and equipped on a second side of said plate for a fluid-tight connection at said second side of said plate, and the remaining similarly separated pair of perforations of said plate serving respectively as inlet and outlet for leading a second fluid into and out of a said flow chamber on said second side of said plate and equipped for a fluid-tight connection at said first side of said plate, said fluid-tight connections in each case being connections to an adjacent perforation of an adjacent plate of said stack;

means, provided in said means for compressibly stacking said plates, for respectively permitting supply and removal of said first and second fluids to and from said stack of plates, and, in accordance with the invention;

said sealing means being constituted, at least over a major portion of their perimetric length, by a plurality of sealing profile members (15, 16) spaced from each other by a substantially constant spacing with; and neighboring sealing profile members of each said sealing means being integrally connected to each other by transverse bridges (18) of the same material as the material of said sealing profile members.

2. The plate heat exchanger of claim 1, wherein each of said sealing means between a pair of adjacent plates defining a said flow channel includes portions constituted by a plurality of sealing profile members, which are provided between said flow channel and each of those of said perforations (4, 5) which are not connected to said flow channel and serve only for the transfer of a said fluid heat exchange medium between said pair of plates across a gap between the pair of plates.

3. The plate heat exchanger of claim 1, wherein each of said sealing means comprises a plurality of sealing profile members spaced from each other by a constant spacing width provided all the way around in the perimeter region of said plates.

4. The plate heat exchanger of claim 2, wherein each of said sealing means comprises a plurality of sealing profile members spaced from each other by a constant spacing width provided all the way around in the perimeter region of said plates.

5. The plate heat exchanger of claim 1, wherein said positioning means on said plates for assuring the location of said sealing profile members are holding grooves respectively formed into the plates which said profile members seal, the total depth of opposing grooves into which a said sealing profile member is inserted being substantially less than the height of the sealing profile member measured in the direction perpendicular to the plates sealed together thereby.

6. The plate heat exchanger of claim 2, wherein said positioning means on said plates for assuring the location of said sealing profile members are holding grooves respectively formed into the plates which said profile members seal together, the total depth of opposing grooves into which a said sealing profile member is inserted being substantially less than the height of the sealing profile member measured in the direction perpendicular to the plates sealed together thereby.

7. The plate heat exchanger of claim 3, wherein said positioning means on said plates for assuring the location of said sealing profile members are holding grooves respectively formed into the plates which said profile members seal together, the total depth of opposing grooves into which a said sealing profile member is inserted being substantially less than the height of the sealing profile member measured in the direction perpendicular to the plates sealed together thereby.

8. The plate heat exchanger of claim 4, wherein said positioning means on said plates for assuring the location of said sealing profile members are holding grooves respectively formed into the plates which said profile members seal together, the total depth of opposing grooves into which a said sealing profile member is inserted being substantially less than the height of the sealing profile member measured in the direction perpendicular to the plates sealed together thereby.

9. The plate heat exchanger of claim 5, wherein the height of said bridges (18) is substantially less than the portion of the height of said sealing profile members which is not inserted in said grooves, so that a channel (17) is formed which is continuous around the region adjacent to the plate perimeters of neighboring plates sealing means.

10. The plate heat exchanger of claim 6, wherein the height of said bridges (18) is substantially less than the portion of the height of said sealing profile members which is not inserted in said grooves, so that a channel (17) is formed which is continuous around the region adjacent to the p late perimeters of neighboring plates sealing means.

11. The plate heat exchanger of claim 7, wherein the height of said bridges (18) is substantially less than the portion of the height of said sealing profile members which is not inserted in said grooves, so that a channel (17) is formed which is continuous around the region adjacent to the plate perimeters of neighboring plates sealing means.

12. The plate heat exchanger of claim 8, wherein the height of said bridges (18) is substantially less than the portion of the height of said sealing profile members which is not inserted in said grooves, so that a channel (17) is formed which is continuous around the region adjacent to the plate perimeters of neighboring plates sealing means.

13. The plate heat exchanger of claim 9 wherein the profiling of each plate between two neighboring grooves (25, 26) for said sealing means is reduced in its height at locations of said bridges.

14. The plate heat exchanger of claim 10 wherein the profiling of each plate between two neighboring grooves (25, 26) for said sealing means is reduced in its height at locations of said bridges.

15. The plate heat exchanger of claim 11 wherein the profiling of each plate between two neighboring grooves (25, 26) for said sealing means is reduced in its height at locations of said bridges.

16. The plate heat exchanger of claim 16 wherein the profiling of each plate between two neighboring grooves (25, 26) for said sealing means is reduced in its height at locations of said bridges.

17. The plate heat exchanger of claim 9, wherein bores (24) are provided through the plates connecting with said channels (17) formed between neighboring sealing profile members of said sealing means for filling in and removing a third fluid medium at a pressure between the environmental pressure outside said heat exchanger and the pressures of said first and second fluid media.

18. The plate heat exchanger of claim 10, wherein bores (24) are provided through the plates connecting with said channels (17) formed between neighboring sealing profile members of said sealing means for filling in and removing a third fluid medium at a pressure between the environmental pressure outside said heat exchanger and the pressures of said first and second fluid media.

19. The plate heat exchanger of claim 11, wherein bores (24) are provided through the plates connecting with said channels (17) formed between neighboring sealing profile members of said sealing means for filling in and removing a third fluid medium at a pressure between the environmental pressure outside said heat exchanger and the pressures of said first and second fluid media.

20. The plate heat exchanger of claim 12, wherein bores (24) are provided through the plates connecting with said channels (17) formed between neighboring sealing profile members of said sealing means for filling in and removing a third fluid medium at a pressure between the environmental pressure outside said heat exchanger and the pressures of said first and second fluid media.

21. The plate heat exchanger of claim 17, wherein means are provided for maintaining the pressure of said third medium at a mean pressure relative to said environmental pressure and said pressures of said first and second fluid media.

22. The plate heat exchanger of claim 18, wherein means are provided for maintaining the pressure of said third medium at a mean pressure relative to said environmental pressure and said pressures of said first and second fluid media.

23. The plate heat exchanger of claim 19, wherein means are provided for maintaining the pressure of third medium at a mean pressure relative to said environmental pressure and said pressures of said first and second fluid media.

24. The plate heat exchanger of claim 20, wherein means are provided for maintaining the pressure of said third medium at a mean pressure relative to said environmental pressure and said pressures of said first and second fluid media.

25. The plate heat exchanger of claim 17, wherein at least the area of said plates adjacent to their respective perimeters are all fitted flush together and releasably compressed between a backing plate and a cover plate by means of a frame and wherein said backing plate (30) or said cover plate (31) or both said backing plate and said cover plate have connections with said channels (17) between neighboring profile members of said sealing means between said plates for supply and optionally also removal of said third fluid medium.

26. The plate heat exchanger of claim 18, wherein at least the areas of said plates adjacent to their respective perimeters are all fitted flush together and releasably compressed between a backing plate and a cover plate by means of a frame and wherein said backing plate (30) or said cover plate (31) or both said backing plate and said cover plate have connections with said channels (17) between neighboring profile members of said sealing means between said plates for supply and optionally also removal of said third fluid medium.

27. The plate heat exchanger of claim 19, wherein at least the areas of said plates adjacent to their respective perimeters are all fitted flush together and releasably compressed between a packing plate and a cover plate by means of a frame and wherein said backing plate (30) or said cover plate (31) or both said backing plate and said cover plate have connections with said channels (17) between neighboring profile members of said sealing means between said plates for supply and optionally also removal of said third fluid medium.

28. The plate heat exchanger of claim 20, wherein at least the areas of said plates adjacent to their respective perimeters are all fitted flush together and releasably compressed between a packing plate and a cover plate by means of a frame and wherein said backing plate (30) or said cover plate (31) or both said backing plate and said cover plate have connections with said channels (17) between neighboring profile members of said sealing means between said plates for supply and optionally also removal of said third fluid medium.

* * * * *

UNITED STATES PATENT AND TRADEMARK OFFICE

CERTIFICATE OF CORRECTION

PATENT NO. : 5,193,612

DATED : March 16, 1993

INVENTOR(S) : Stirnkorb

It is certified that error appears in the above-indentified patent and that said Letters Patent is hereby corrected as shown below:

Column 7, lines 13-17 (claim 1), delete:

"positioning means, provided on at least half of said plates which are releasably stacked together, for assuring location of said sealing means in said region of said plates when said plates are stacked together;"

Column 7, line 47 (claim 1), "with" should be --width--; and insert the following after ";" and before "and":

--positioning means associated with each sealing member provided on said plates for assuring location of said sealing means in said region of said plates when said plates are stacked together;--.

Column 8, line 7 (claim 5), after "seal", insert --together--

Column 9, line 11 (claim 16), "of claim 16" should be --of claim 12--

Signed and Sealed this

Seventeenth Day of June, 1997

Bruce Lehman

*Attest:*

BRUCE LEHMAN

*Attesting Officer*

*Commissioner of Patents and Trademarks*